United States Patent [19]

Armstrong, Jr.

[11] Patent Number: 4,833,831

[45] Date of Patent: May 30, 1989

[54] APPARATUS AND METHOD FOR SIZING AND FINISHING FIXED JAW OPENINGS OF OPEN-ENDED WRENCHES

[75] Inventor: William T. Armstrong, Jr., Libertyville, Ill.

[73] Assignee: Armstrong Bros. Tool Co., Chicago, Ill.

[21] Appl. No.: 947,046

[22] Filed: Dec. 29, 1986

[51] Int. Cl.[4] ..... B24B 19/00

[52] U.S. Cl. ..... 51/34 R; 51/56 R; 51/98 R; 51/125; 51/277; 51/281 R; 51/217 R; 409/132; 409/225

[58] Field of Search ..... 51/34 R, 34 C, 34 D, 51/34 E, 34 F, 34 G, 37, 56 R, 74 R, 92 R, 98 R, 98.5, 110, 122, 125, 125.5, 215 R, 215 CP, 217 R, 240 R, 277, 281 R; 409/132, 225, 244, 251, 252, 256, 257, 276, 277, 278; 269/254 R

[56] References Cited

U.S. PATENT DOCUMENTS

| | | | |
|---|---|---|---|
| 28,714 | 6/1860 | Godfrey | 269/254 R |
| 605,855 | 6/1898 | Colborne | 269/254 R |
| 2,518,018 | 8/1950 | Jung | 51/34 C |
| 3,086,508 | 4/1963 | Carlsen et al. | 51/34 R X |
| 3,397,491 | 8/1968 | Keith | 51/34 R |
| 3,611,644 | 10/1971 | Dillberg | 51/217 R X |
| 3,840,000 | 10/1974 | Bible | 51/217 R X |
| 3,984,213 | 10/1976 | Kelso | 51/281 R |
| 4,001,975 | 1/1977 | Bernard et al. | 51/219 PC X |
| 4,212,573 | 7/1980 | Fields | 409/257 X |

*Primary Examiner*—Robert P. Olszewski

*Attorney, Agent, or Firm*—Lackenbach Siegel Marzullo & Aronson

[57] ABSTRACT

A system and a method for sizing and finishing the opposed interior side walls and the interior bottom wall between the fixed jaws of an open-ended wrench. The system includes a creep feed grinding machine, a fixture to which the wrenches are secured, a jig that maintains the fixture under the creep feed grinding wheel, and a hydraulic table holding the jig and which slowly raises the jig, fixture, and handles to be ground to the grinding wheel. The method includes securing the fixture to a mounting support, activating a fluid pressure mechanism to release a clamping bar holding the wrenches to a plate member, mounting the wrenches to the fixture, and releasing the clamping bar which is then biased back to its original position so as to clamp the wrenches to the fixture. The fixture is than moved to the jig for the grinding operation.

33 Claims, 8 Drawing Sheets

10
11
L
W
HB
WA
T
T1

APPARATUS AND METHOD FOR SIZING AND FINISHING FIXED JAW OPENINGS OF OPEN-ENDED WRENCHES

BACKGROUND OF THE INVENTION

This invention relates generally to the field of fixed-opening wrenches and more particularly to machining an open-ended wrench.

The open head at one or both ends of a handle of a standard fixed-jaw, open-ended wrench, is first forged then trimmed. The forging process leaves a web at the jaw end of the wrench and a rough finish of the interior surfaces of the jaws. The web is a thin layer of metal left in the area between the jaws of the wrench. The machining process presently used in the industry to remove the web and rough portions in the gripping area between the jaws of such wrenches is either broaching by the use of a broaching tool or milling by the use of a rotary cutter. Both broaching and milling leave either broaching or milling marks on the inner surface of the jaws opening. In addition, the jaws may spread during the broaching process and must be forced together after final heat treatment, with the result that some breakage could occur. A hardening, or heat treatment, process then follows. During the heat treatment some decarburization may occur because of minor variations in material chemistry with the result that the surface of the wrench is somewhat softened. Polishing or surface preparation, such as with nickel, chrome, or other materials completes the process.

Grinding of wrenches has generally not been used because of its impracticality; more particularly, grinding is a very slow operation and is very expensive. Also, the grinding wheel wears out with the result that the size of the grinding wheel changes so that all three sides of the jaw opening cannot be ground at the same time.

A grinding technique or process described in U.S. Pat. No. 3,984,213, issued Oct. 5, 1976 to W. Kelso, is generally known in the art as "creep feed grinding". Creep feed grinding involves slowly feeding the workpiece past a form grinding wheel set to the full depth of cut. The desired detail is produced in the workpiece in a single pass under the wheel. Also, parts are produced to a very high accuracy without burrs or distortion.

The Kelso patent is directed to the creep feed grinding of particular materials considered difficult to grind because of having a low machinability factor, namely AMS 5706 or the like, AMS 5663, AMS 5754, which has a machinability factor of 18, titanium, a titanium alloy, AMS 4928, and a cobalt base alloy, PWA 691. Although the patent mentions that the process is usable for materials presently ground in the conventional manner, it covers in fact materials normally considered difficult to grind by reason of wheel loading or thermal damage to the workpiece. The patent is limited to particular wheel surface speeds and feed rate of the workpiece relative to the workpiece.

SUMMARY OF THE INVENTION

It is an object of this invention to provide a process for grinding of open-ended wrenches after the hardening process rather than before so as to achieve a high degree of finish and dimensional consistency after the hardening process.

It is yet another object of this invention to provide a process for assembling open-ended wrenches to a fixture and creep feed grinding the open ends.

It is still another object of this invention to provide a fixture for assembling open-ended wrenches for subsequent creep feed grinding of the open ends of the wrenches.

The present invention sets forth a system for sizing and finishing the opposed interior side walls and the interior bottom wall between the fixed jaws of an open-ended wrench. The system includes a creep feed grinding machine, a fixture to which the wrenches to be ground are secured, a jig that maintains the fixture under the creep feed grinding wheel, and a hydraulic table holding the jig and which slowly raises the jig, fixture, and handles to be ground to the grinding wheel. The method includes securing the fixture to a mounting support, activating a fluid pressure mechanism to release a clamping bar holding the wrenches to a plate member, mounting the wrenches to the fixture, and releasing the clamping bar which is then biased back to its original position so as to clamp the wrenches to the fixture. The fixture is than moved to the jig for the grinding operation.

The advantages of the above-described invention are as follows:

1. Better tolerance control.
2. Better parallelism between the jaws.
3. Superior finish.
4. Major elimination of the possibility of a soft skin on the wrench surfaces leading to significantly improved durability.

The present invention will be better understood, and the objects and important features, other than those specifically enumerated above, will become apparent when consideration is given to the following details an description, which when taken in conjunction with the annexed drawings, describes, discloses, illustrates, and shows preferred embodiments or modifications of the present invention and what is presently considered and believed to be he best mode of practice in the principles thereof. Other embodiments or modifications may be suggested to those having the benefit of the teachings herein, and such other embodiments or modifications are intended to be reserved especially as they fall within the scope and spirit of the subjoined claims.

DESCRIPTION OF THE PREFERRED EMBODIMENT

Figure 1:
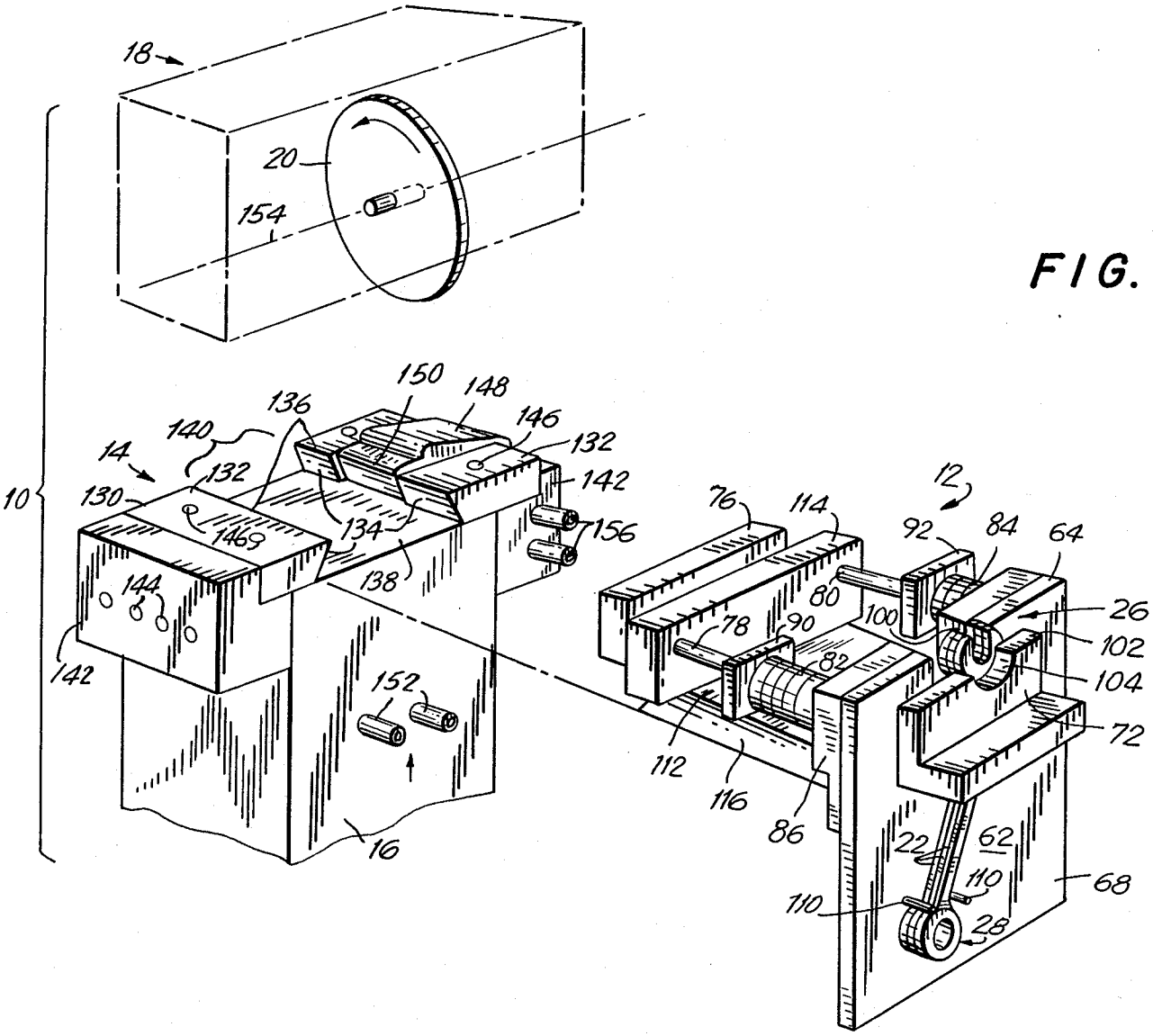
FIG. 1 is an exploded perspective view of the invention showing the fixture mounted with open ended wrenches ready for assembly to a jig upon a hydraulic table ready for operation at a creep feed grinding wheel.

Reference is now made specifically to the drawings in which identical or similar parts are designated by the same reference numerals throughout.

A system 10 for sizing and finishing open-ended wrenches shown in an exploded perspective view in FIG. 1 includes a fixture 12 ready for mounting to a jig 14 that is secured to a hydraulic table 16 positioned under a creep feed grinding machine 18 shown schematically in phantom line including a creep feed grinding wheel 20. Three unfinished open-ended wrenches 22 are mounted to fixture 12.

Figures 8, 9, 10, 11, 12, 13:
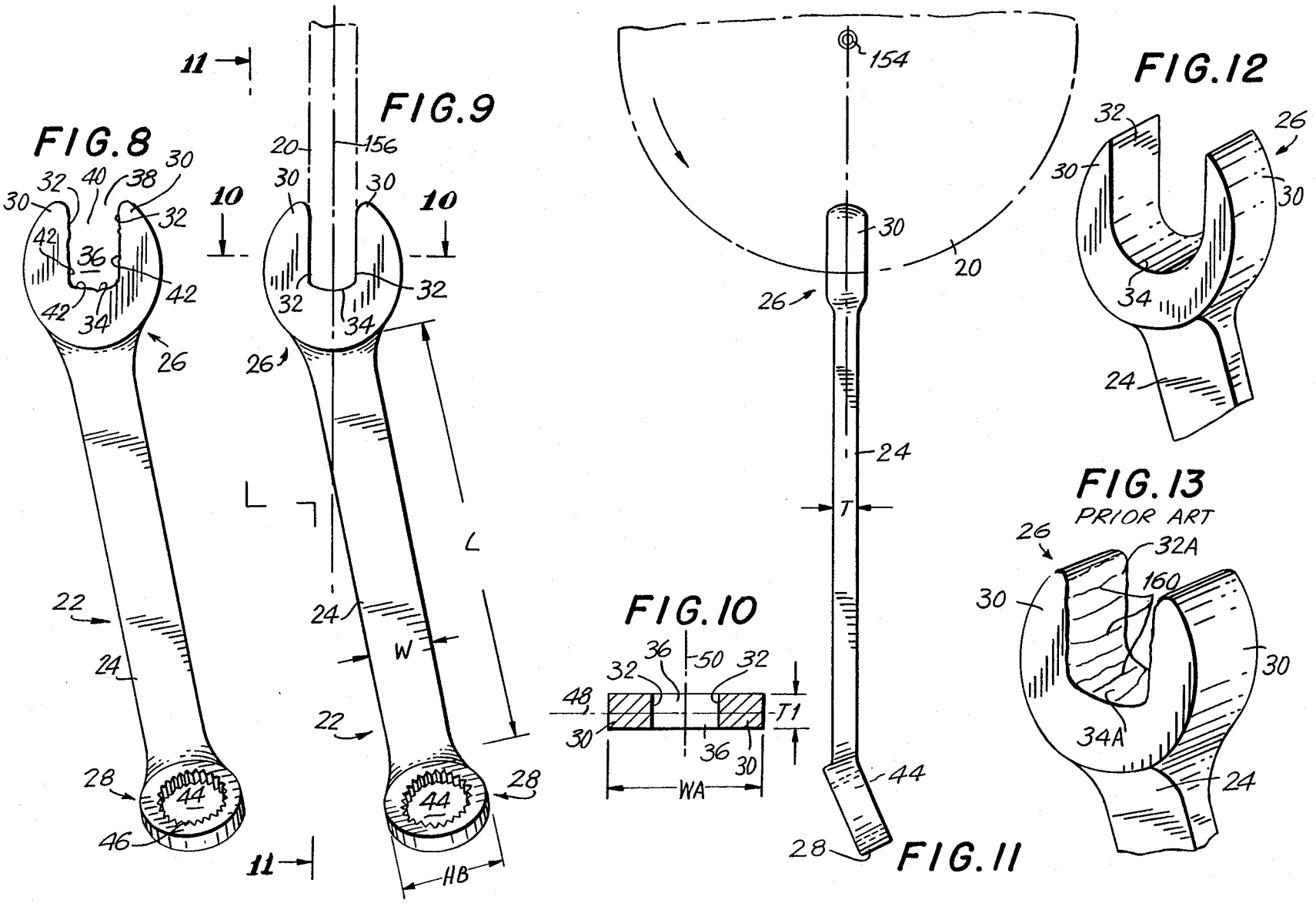
FIG. 13 PRIOR ART
FIG. 8 is a front view of an open-ended wrench prior to being sized and finished.
FIG. 9 illustrates a side view of a typical open ended wrench having just been ground with a creep feed grinding wheel shown in phantom line.
FIG. 10 is a view taken through line 10—10 in FIG. 9.
FIG. 11 is a view taken through line 11—11 in FIG. 9.
FIG. 12 is a perspective view of an open head with a mirror finish after being sized and finished by a feed grinding wheel.
FIG. 13 is a view of an open head after being milled or broached in the manner of the prior art.

A single unfinished open-ended wrench shown in FIG. 8 includes an elongated straight handle 24 having opposed ends, an open head 26 at one of the opposed ends, and a generally circular closed head 28 at the other of the opposed ends. Open head 26 includes a pair of straight jaws having interior side walls 32. An interior bottom wall 34 extends between interior side walls 32. Side walls 32 and bottom wall 34 define a wrench gripping space 36 between jaws 30 having a fixed opening 38. FIG. 8 shows wrench 22 in its unfinished state with a thin web 38 extending across gripping space 36 and with interior side walls 32 and interior bottom wall 34 having irregularities 42. Closed head 28 has a gripping eye with an interior cylindrical surface having transverse gripping serrations 46. The corners at which interior side walls 32 and interior bottom wall 34 meet are slightly rounded with short radii, typically 5/32 inch with a wrench length of about 6.3 inches. Bottom wall 34 also is slightly rounded with a radius of about $\frac{5}{8}$ inch for a wrench of the same length. Wrenches 22 are typical open-ended wrenches and the invention includes wrenches of a plurality of lengths. Handle 24 has a length L (FIG. 9), a width W (FIG. 9), and a thickness T (FIG. 11). Open head 26 has a head width WA (FIG. 10) greater than width W of handle 24. Likewise, closed head 28 has a head width HR (FIG. 9) greater than width W of handle 24. As is common in the art, closed head 28 is angled slightly from handle 24 relative the side or the T dimension of handle 24 as shown in FIG. 11; and open head 26 is angled slightly from handle 24 relative the front or W dimension as shown in FIGS. 8 and 9. Jaws 30 in general and parallel interior side walls 32 in particular are angled slightly from the width dimension of handle 24 as seen best in FIG. 9. A plane extending across jaws 30 extending midway between the thickness dimension T1 is shown as midplane 48 in FIG. 10; and a plane extending midway between jaws 30 is shown as center plane 50 in FIG. 10. Midplane 48 and center plane 50 are perpendicular to one another.

Wrenches 22 are mounted to fixture 12 in the manner illustrated in FIGS. 2–5 prior to fixture 12 being mounted to jig 14. Fixture 12 is shown in an inversed position in FIGS. 2–5 relative to its position in FIG. 1. Fixture 12 is set upon a plate mounting support 52 that lies horizontally on the top of a table 54. Mounting support 52 has a front portion 56 and a rear portion 58 with rear portion 58 having a slightly greater thickness than front portion 56 with a transverse step 60 extending between the front and rear portions.

Figure 2:
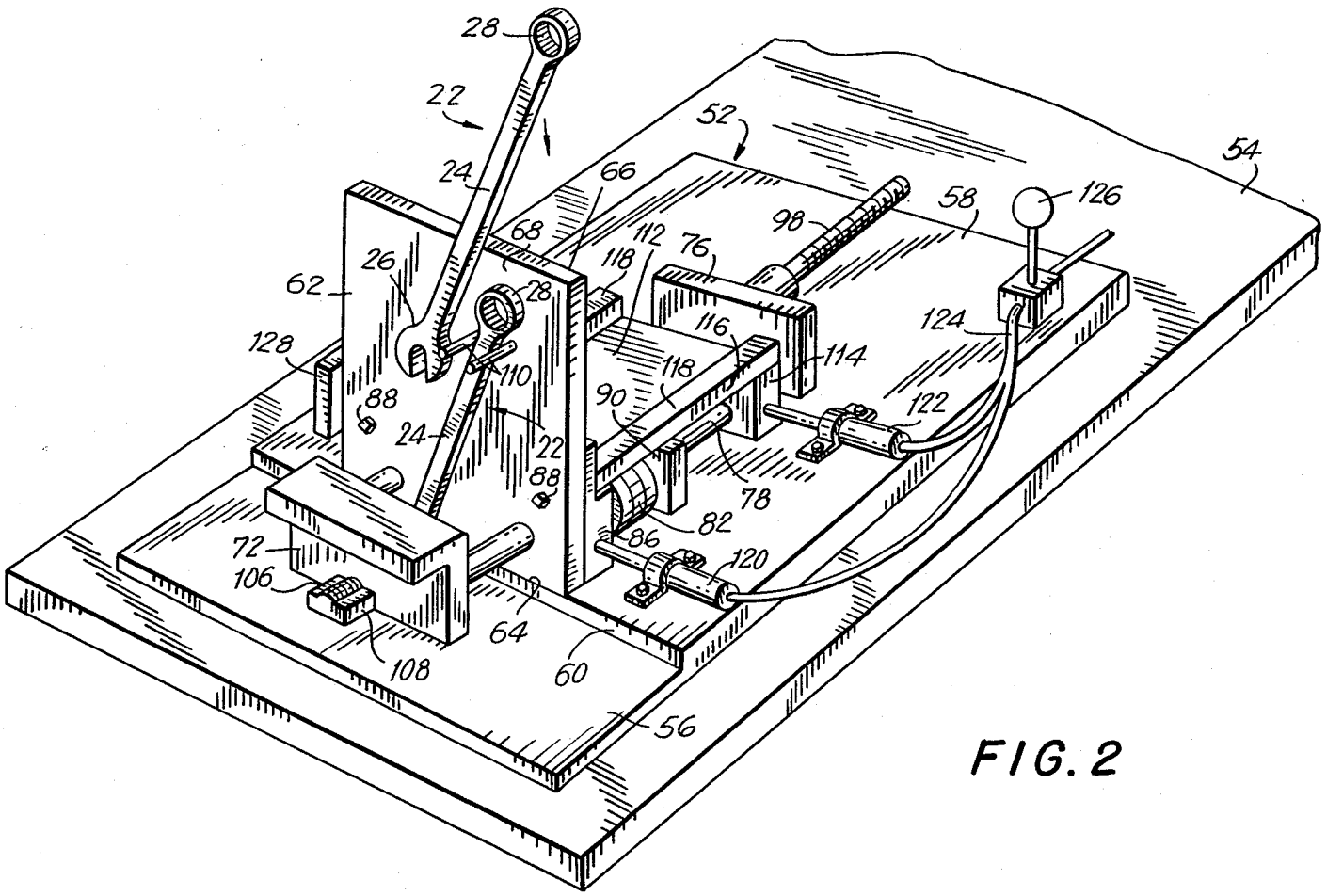
FIG. 2 is a perspective view of the fixture being loaded with open-ended wrenches.
Figure 3:
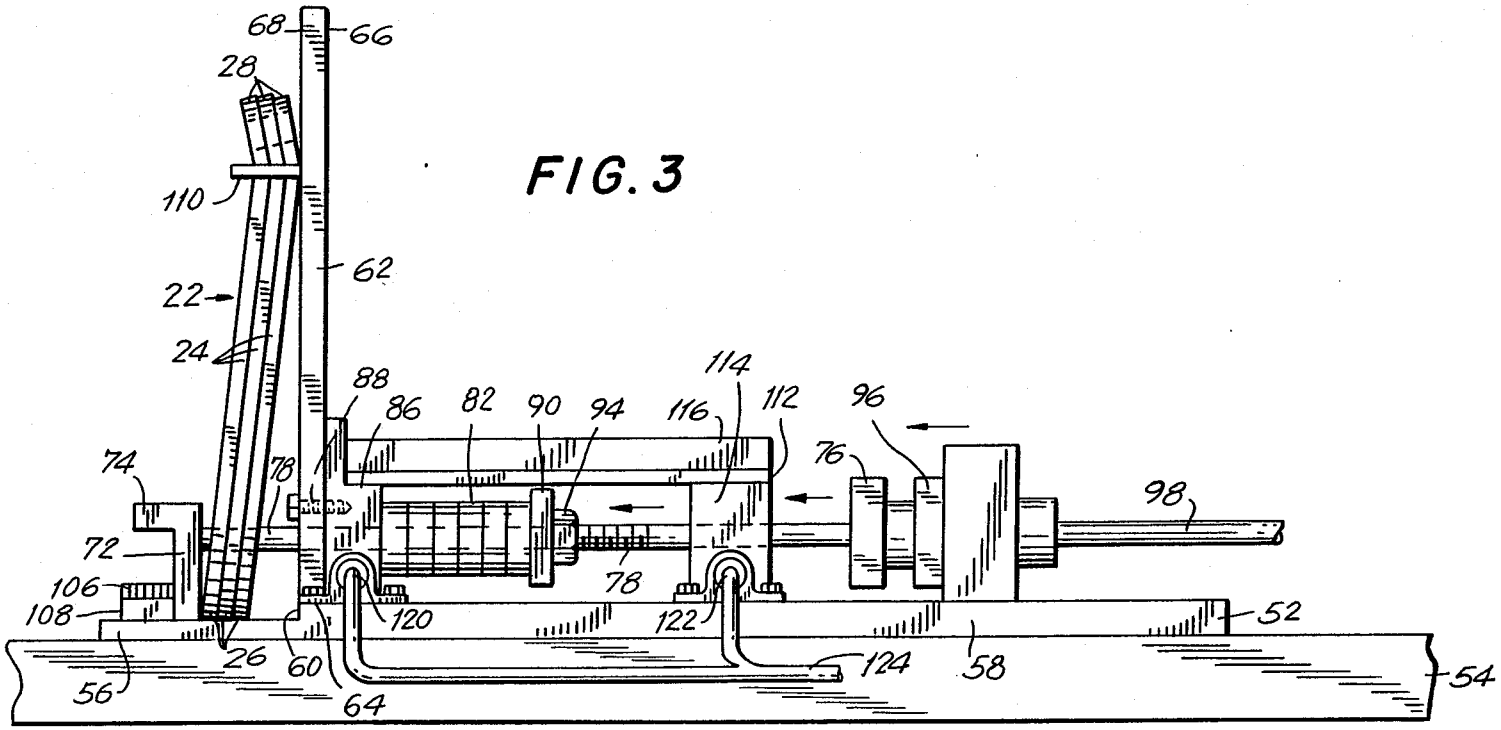
FIG. 3 is a side view of the fixture loaded with wrenches prior to clamping of the wrenches.
Figure 4:
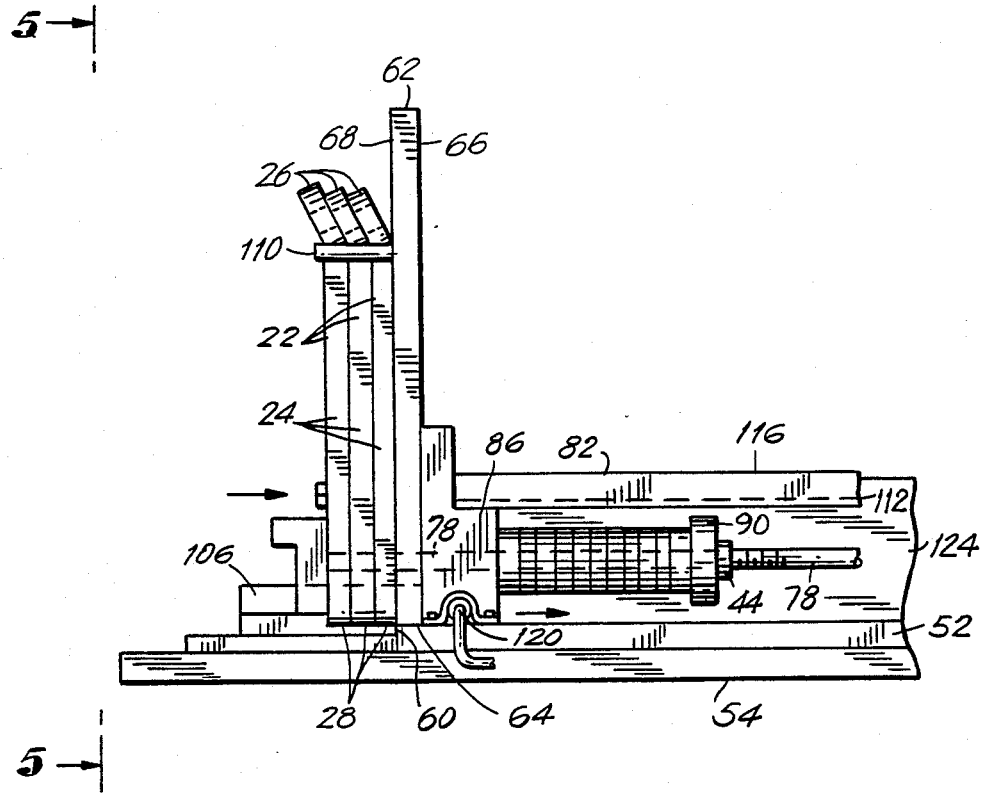
FIG. 4 is a broken side view of the fixture after activation of the clamping mechanism locking the wrenches to the fixture.
Figure 5:
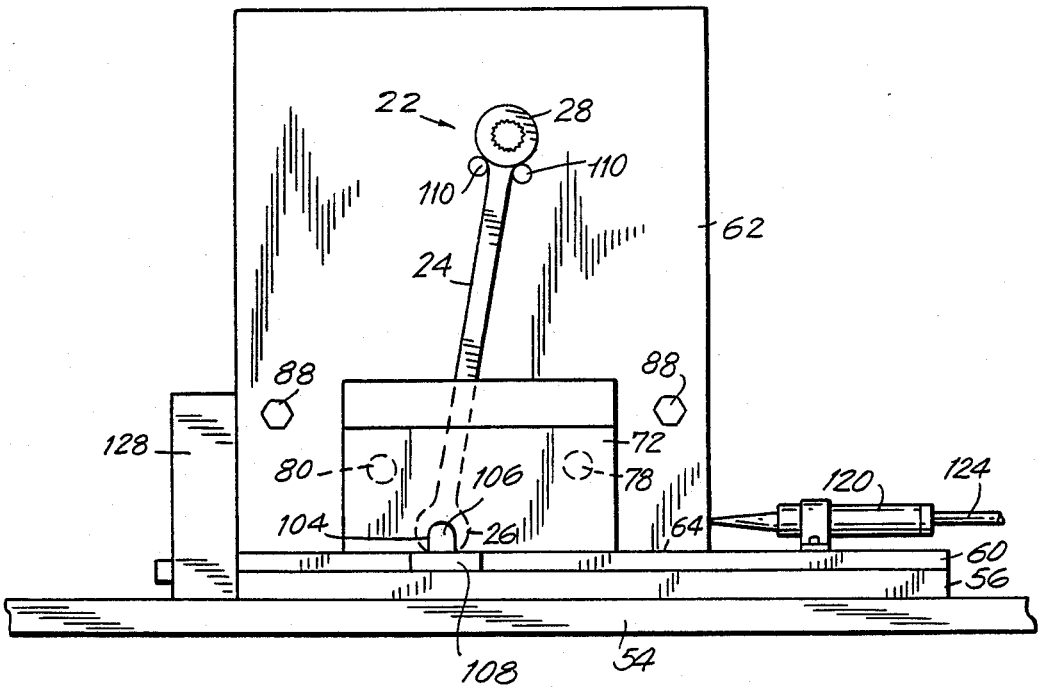
FIG. 5 is a front view of the fixture with locked wrenches.
Figure 6:
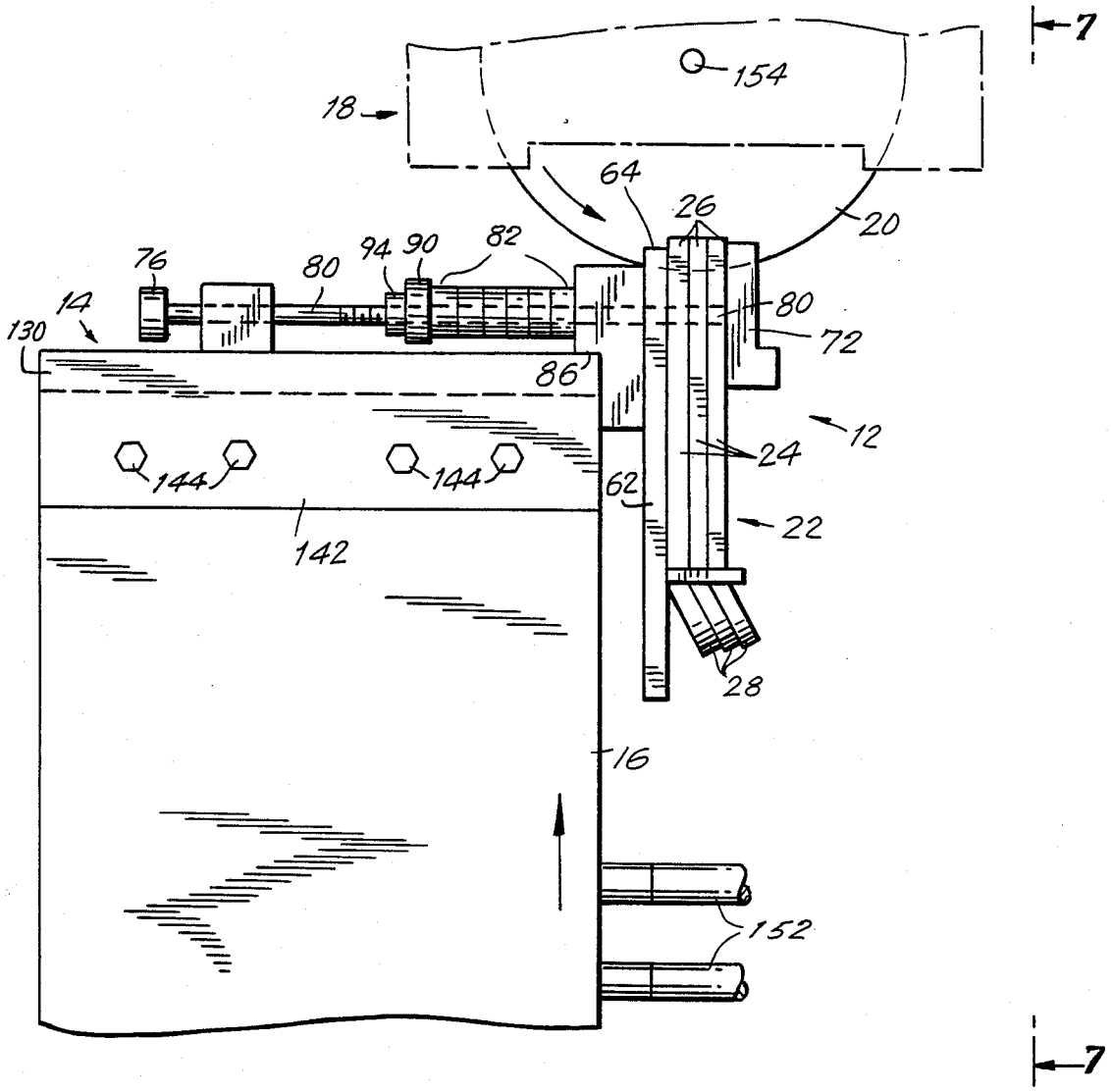
FIG. 6 is a side view of the fixture holding open ended wrenches mounted to a jig upon a hydraulic table being raised to a creep feed grinding wheel.
Figure 7:
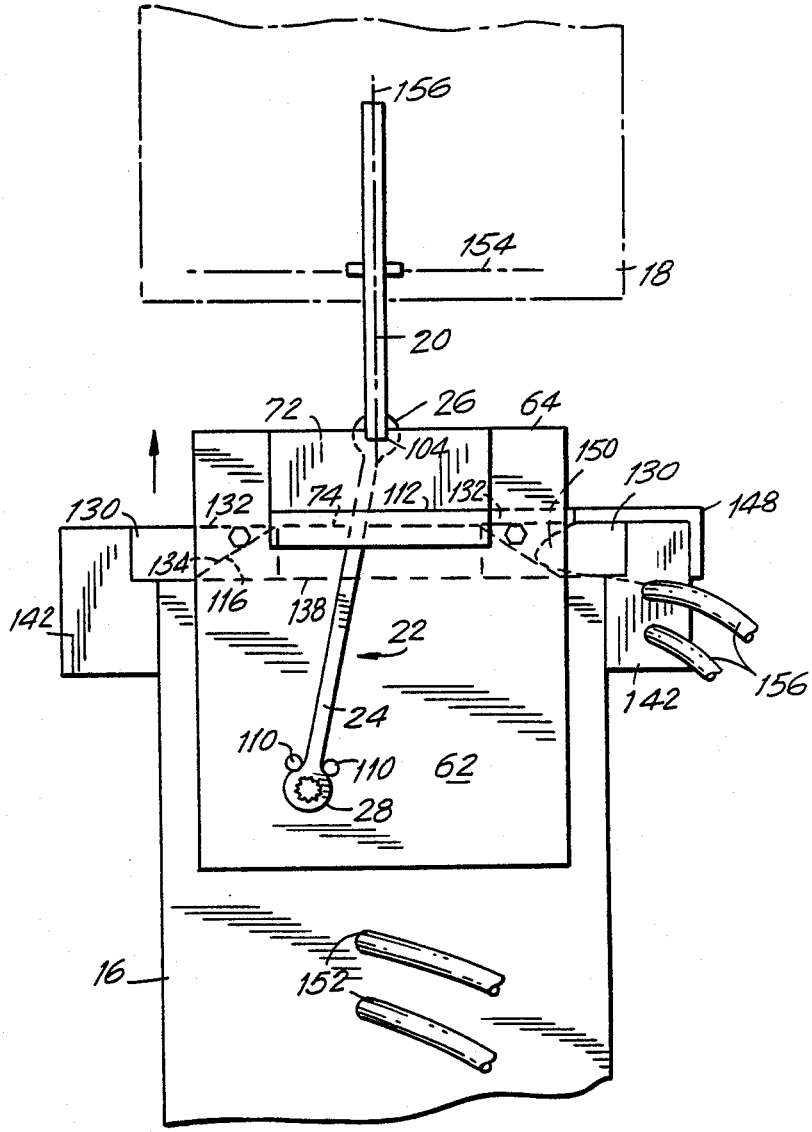
FIG. 7 is a view taken through line 7—7 in FIG. 6.

Fixture 12 includes a plate member 62 having a transverse edge 64 set upon and transversely positioned across the rear portion of mounting support 52 in alignment with step 56. Plate member 62 has reverse inner and outer surfaces 66 and 68, respectively, oriented toward rear and front portions 58 and 56, respectively. A clamping bar 72 having a contact surface facing outer surface 68 of plate member 62 is positioned spaced from outer surface 68 of plate member 62 at an unclamping distance such that the open heads 26 of the three wrenches 22 can be placed in the space between the contact surface of clamping bar 72 and plate member 62 as shown in FIG. 2, or, conversely, removed from the space. Clamping bar 72 has a strengthening portion 74 that extends transversely across the reverse side of the clamping bar from its contact surface. Clamping bar 72 is maintained at its unclamping position by pressure being exerted on a push bar 76 which is connected to each of one end of a pair of parallel piston rods 78 and 80 which in turn are connected at their opposed ends to the contact surface side of clamping bar 72. Push bar 76 is positioned spaced from inner surface 66 of plate member 62. Clamping bar 72 is movable from the unclamping position to a clamping position, which is illustrated in FIG. 4 and which is the position of clamping bar 72 when it is mounted to jig 14 as seen in FIGS. 1, 6, and 7. In the clamping position clamping bar 72 is positioned at a clamping distance that is less than the above-described unclamping distance, which is such that the three wrenches 22 are pressed between contact surface of clamping bar 72 and outer surface 68 of plate member 62 at such a pressure that the three wrenches 22 are maintained in an immobile position during the grinding operation shown in FIGS. 1, 6, and 7. Clamping bar 72 is maintained in its clamping position by a biasing force that includes two helical washers 82 and 84, or disk springs, that are mounted at their central holes to piston rods 78 and 80, respectively. Helical washer sets 82 and 84 are operatively biased between inner surface 66 of plate member 62 and a pair of bracing members 90 and 92, which have central holes that slidably receive piston rods 78 and 80, respectively. A pair of nuts 94 (one of which is shown in FIGS. 3, 4, and 5) are threaded onto piston rods 78 and 80 at piston threads. Nuts 94 press against one end of washers 82 and 84 and bear up against bracing members 90 and 92 so that sets of washers 82 and 84 have bearing surfaces at both ends of each set. Washers 82 and 84 bear against inner surface 66 of plate member 62 by way of a support bar 86 that extends laterally across inner surface 66 and is secured to plate member 62 by a pair of bolts 88 having heads at outer surface 68; washers 82 and 84 bear directly against support bar 86 with the bearing force transferred to plate member 62. Support bar 86 rests upon mounting support 52 and extends transversely to piston rods 78 and 80, which pass slidingly through support bar 86. Helical washer sets 82 and 84 ar movable between biased and unbiased modes wherein the unbiased mode washer sets 82 and 84 have biased bracing member 90 away from inner surface 66 of plate member 62 so as to move clamping bar 72 to its clamping position, and wherein in the biased mode bracing member 90 has been moved toward inner surface 66 of plate member 62 so as to force piston rods 78 and 80 via nuts 94 to move clamping bar 72 to its unclamping position and to force washer sets 82 and 84 to a biased mode between bracing member 90 and plate member 62. Bracing member 90 is movable toward plate member 62 so as to force clamping bar 62 to its unclamping position and helical washer sets 82 and 84 to their biased modes by the action of a piston head 96 in contact with push bar 76 and that is connected to a drive rod 98 that is in turn connected to a pressure device (not shown) in turn connected to a source of hydraulic pressure (not shown). When the hydraulic pressure is released from exertion of force against push bar 76, helical washer sets 82 and 84 move from their biased to their unbiased modes and so pull clamping bar 72 to its clamping position by forcing push bar 72 away from plate member 62.

Plate member 62 forms an aperture 100, seen best in FIG. 1, at the center of transverse edge 64. Clamping bar 72 has an edge 102 aligned with transverse edge 64 which also forms an aperture 104, seen in FIGS. 1, 5, and 7 which is aligned with aperture 100. An elongated key 106 connected to an elongated support 108 that is connected to front portion 56 of mounting support 52 is positioned in apertures 100 and 104. Key 106 is of the same dimensions as gripping space 36 of open head 26 of handles 22.

A pair of support pins 110 spaced slightly apart extend perpendicularly from outer surface 68 of plate member 62. Wrenches 22 are supported at their closed heads 28 by support pins 110 with the support pins being apart just enough to accept the widths W of handles 24 so that head widths HW cannot pass through the space between the connecting pins. As seen in FIGS. 2 and 3, in mounting each wrench 22 to fixture 12, the wrench is first hung at its closed head 28 from support pins 110 and then open end 28 is inserted into the space between plate member 62 and clamping bar 72 and gripping space 36 of open head 26 is then fitted over key 106. This is done for each of the three wrenches 22 until the configuration shown in FIG. 3 with three mounted wrenches to fixture 12 is attained. Thereupon the pressure device mentioned above is deactivated so as to remove the pressure exerted by piston rod 98 against push bar 76 so that bracing members 90 and 92 are biased away from plate member 62 by helical washer sets 82 and 84 and clamping bar 72 is pulled into its clamping position as shown in FIG. 3 with handles 24 of wrenches 22 being pressed between plate member 62 and clamping bar 72 with sufficient force so as to hold wrenches immobile during the grinding operation.

A support plate 112 extends transversely generally from inner surface 66 of plate member 62 and particularly from support bar 86. Support plate 112 extends over and beyond helical spring sets 82 and piston rod 78 as illustrated in FIG. 3 to another support bar 114 similar to support bar 86 and which extends transversely to piston rods 78 and 80 across fixture 12, that is, laterally to plate member 62. Like support bar 86, support bar 114 rests upon mounting support 52. Piston rods 78 and 80 pass slidingly through support bar 114.

A pair of opposed key gripping walls 116 extend at an angle outwardly and upwardly from support plate 112 as illustrated in FIGS. 2–4, and a pair of elongated key flat walls 118 extend horizontally inwardly from the edges of key gripping walls 116, which are angled outwardly and upwardly in the orientation of fixture 12 shown in FIGS. 2–4 so as form a fixture key that fits into a keyway of jig 14 in a manner that will be described when fixture 12 is inverted as illustrated in the orientations shown in FIGS. 1, 6, and 7.

Fixture 12 is kept in nonmovable relationship to mounting support 52 by a pair of fluid pressure devices 120 and 122 secured to mounting support 52 and connected to a source of fluid pressure (not shown) by a fluid pressure line 124 connected to a valve box having a control handle 126. Support bars 86 and 114 each have opposed end portions, each one end portion having an aperture leading to a fluid chamber and each other end portion being in contact with a side bar 128 secured to mounting support 52. The nozzles of fluid pressure devices 120 and 122 are adapted to be inserted into the apertures of support bars 86 and 114, respectively, so that when fluid pressure is applied to devices 120 and 122 by activating of control handle 126, sufficient pressure is applied to support bars 86 and 114 so their end portions adjacent to side bar 128 are pressed against the side bar with sufficient force to immobilize fixture 12 relative to mounting support 52.

The activation of pressure devices 120 and 122 is followed by the activation of the pressure device for piston 96 for movement of clamping bar 72 from its clamping position to its unclamping position. After mounting clamps 22 to fixture 12, the pressure device for piston 96 is deactivated and clamping bar 72 is biased to its clamping position. Pressure devices 120 and 122 are then deactivated. Fixture 12 is then removed from mounting support 52 and inverted so that transverse edge 64 of plate member 62 along with fixed openings 28 of wrenches 22 are repositioned from their downward orientation as illustrated in FIGS. 2–5 to an upward orientation as illustrated in FIGS. 1, 6, and 7. Fixture 12 is then mounted to jig 14.

Jig 14 includes a pair of spaced keyway gripping members 130 having top walls 132 and opposed gripping side walls 134 angled downwardly and outwardly apart from one another from their opposed lateral edges 136 at the intersections of top walls 132 and side walls 134 to the horizontal top wall 138 of hydraulic table 16 so that opposed gripping side walls 134 combined with top wall 138 form a keyway 140 that receives key gripping walls 116 along keyway gripping side walls 134 and key flat walls 118 along table top wall 138.

A pair of opposed jig support blocks 142 positioned along the outside walls of key gripping members 130 are connected to hydraulic table 16 by side bolts 144. Key gripping members 130 are connected to hydraulic table 16 by top bolts 146 which extend downwardly from top walls 132.

As seen in FIG. 1, a clamping apparatus 148 which includes a keeper wall portion that has an overhanging lip 150 is mounted to jig 14 midway along one of the keyway gripping members 130 and is rotatable about a lateral axis supported by a support block 142 relative to keyway 140 between a raised release position as illustrated in FIG. 1 and a lowered clamping position as illustrated in FIG. 7. The release position shown in FIG. 1 allows insertion of fixture 12 to jig 14 at keyway 140. When clamping apparatus 148 is in its clamping position lip 150 bears on a key gripping wall 116 of fixture 12 so as to maintain fixture 12 in a nonmoving position relative to jig 14. Clamping apparatus 148 is activated by a fluid pressure mechanism located in the support block 142 to which clamping apparatus is rotatably secured. A pair of fluid pressure lines 150 extending from the support block 142 are connected to the fluid pressure mechanism of clamping apparatus 148 and to a source of fluid pressure (not shown).

When fixture 12 with wrenches 22 is mounted to jig 14 and clamping apparatus 148 is activated to as to clamp the fixture to the jig, hydraulic table 16 is activated and fluid pressure is sent to the hydraulic lift mechanism in table 16 via one of the fluid pressure lines 152 from a source of fluid pressure (not shown) so that table 16 is raised to creep feed grinding wheel 20. Wheel 20 is rotatable about a horizontal axis of rotation 154 and has a vertical wheel center plane 156 perpendicular to axis 154. Wrenches 22 are positioned so that jaws center plane 50 is aligned with wheel center plane 156 and jaws midplane 48 is aligned with wheel axis 154. Hydraulic table 16 is slowly raised by the hydraulic lift mechanism in a manner known in the art so that gripping spaces 36 are slowly sized and finished as indicated in FIGS. 7 and 11. During the grinding operation a coolant is applied to the contact area between the wheel and the area of the wrench being ground in a manner known in the art. The finished product is illustrated in FIG. 12 where interior side and bottom surfaces 32 and 34 have a mirror-like finish.

A typical rotational speed of the creep feed grinding wheel is 2500 RPM and a typical feed rate of the wrenches to the creep feed grinding wheel is 3 inches per minute. The finish of the interior surface of the jaws of the wrench is in the order of 32 microns. A typical wrench material is a medium carbon (0.35 to 0.65 percent carbon) alloy steel heat treated to a minimum hardness to 40 on the Rockwell "C" scale.

The sequence preparatory to and subsequent to the grinding operation in its basic form is taken according to the following steps:

(a) placing fixture 12 upon mounting support 52;

(b) securing fixture 12 to mounting support 52;

(c) preparing fixture 12 for receipt of at least one open-ended wrench 22;

(d) placing wrench 22 onto fixture 12;

(e) securing wrench 22 to fixture 12;

(f) unsecuring fixture 12 from mounting support 52;

(g) removing fixture 12 from mounting support 52;

(h) placing and securing fixture 12 along with wrench 22 onto jig 14 secured to vertically movable table 16, jig 14 being positioned under creep feed grinding machine 18, the fixed opening 38 of the open head end 26 of wrench 22 being aligned under creep feed grinding wheel 20, wheel axis 154 being aligned with jaws vertical midplane 48 and center plane 156 of the wheel being aligned with jaws center plane 50;

(i) activating creep feed grinding machine 18;

(j) activating table 16 so that it raises jig 14 and fixture 12 upwardly until gripping space 36 so that the interior side and bottom surfaces of the open jaws are sized and finished in one pass of said grinding wheel 20;

(k) lowering table 16;

(l) removing fixture 12 from jig 14;

(m) placing fixture 12 with the sized and finished wrench 22 upon mounting support 52 as in step (a);

(n) securing fixture 12 to support plate 62 as in step (b);

(o) preparing fixture 12 for removal of sized and finished wrench 22 in the manner of step (c); and (p) removing sized and finished wrench 22 from fixture Step (a) described above includes plate member 12 being placed upon mounting support 52 with aperture 100 being fitted over key 106, plate member 62 being generally perpendicular to mounting support 52 and to key 106.

Step (c) described above includes pressuring clamping bar 72 so as to move the clamping bar from a first position at a first distance from the front or outer surface 68 of plate member 62 to a second distance from the plate member greater than first distance, the clamping bar being held in the first position by biasing elements 82, which are in an unbiased mode when clamping bar 62 is in its first position and in a biased mode when the clamping bar is in its second position.

Step (d) described above includes placing wrench 22 between clamping bar 72 and outer surface 68 of the plate member.

Step (d) further includes the following steps:

(1) hanging the opposed head of wrench 22, which is at the end of the handle opposite the open head, from support members on outer surface 68 of the plate member to hold wrench 22 at the opposed head. Although wrench 22 has been described and is illustrated as having a closed head, it may have an open head or other configuration without affecting the inventiveness of the apparatus or method being described here.

(2) placing gripping space 36 of open head 26 of wrench 22 into alignment with key 106.

Step (e) described above includes releasing the pressure on clamping bar 72 so that clamping bar 62 is forced back to its first position by the biasing elements 82 so that the clamping bar pressures wrench 22 against outer surface 68 of the plate member thus gripping wrench 22 to fixture 12 with gripping space 36 being in alignment with aperture 100 of the plate member.

The step between steps (g) and (h) is inverting fixture 12 so that transverse edge 64 of the plate member and opening 38 of open head 26 of wrench 22 are oriented upwardly.

The step between steps (l) and (m) is inverting fixture 12 so that transverse edge 64 of plate member 62 and opening 38 of open head 26 of the wrench are oriented downwardly.

FIG. 13 illustrates a fragmentary view typical of prior art open-ended wrenches which were either milled or broached. Striations 160 shown on side and bottom walls 32A and 34A are the result of prior art finishing by milling or broaching. Tolerance in the prior art method as shown in FIG. 13 was from zero to 0.006. Tolerance in the present method as shown in FIG. 12 now is zero to 0.004. Under the prior art method every wrench had to be checked with a go/no go gauge. Presently, it is necessary to check approximately only one out of a hundred wrenches, since under the new method there are hardly any defects at all as compared to the old method.

The embodiment of this invention particularly disclosed and described hereinabove is presented merely as an example of the invention. Other embodiments, forms, and modifications of the invention coming within the proper scope and spirit of the appended claims will, of course, readily suggest themselves to those skilled in the art.

What is claimed is:

1. A system for sizing and finishing the opposed interior side walls and in interior bottom wall extending between the interior side walls at an open head at one end of a straight handle of an unfinished open-ended wrench, the interior side walls and the interior bottom wall defining a gripping space between fixed jaws which define an opening to said space, comprising, in combination, a creep feed grinding machine including a creep feed grinding wheel rotatable about an axis and having a wheel center plane perpendicular to said axis, fixture means for gripping at least one wrench, the gripping space having a jaws center plane spaced between the jaws and a jaws midplane extending across said jaws perpendicular to said jaws center plane.

jig means for maintaining said fixture means in a position wherein the jaws of the at least one wrench are positioned directly under said grinding wheel with said jaws center plane aligned with said wheel center plane and said jaws midplane aligned with said wheel axis, keyway means associated with said jig means, key means associated with said fixture means, said key means being removably mounted with said keyway means for preventing said fixture means from moving transversely relative to said jig means in directions parallel to said axis and for preventing said fixture means form moving vertically relative to said jig means during the grinding operation, lifting means for maintaining said jig means under said wheel and for raising said jig means with said fixture means upwardly to said grinding wheel as said grinding wheel sizes and finishes the interior side and bottom surfaces of the jaws of the at least one wrench in a single pass of said wheel, wherein the at least one wrench has an opposed heat at the other end of the handle opposite to the one head, the handle having a handle length, width, and thickness, the opposed head having a head width greater than the handle width, and the open head having an open head width, and wherein said fixture means includes a plate member having reverse inner and outer surfaces and a transverse edge, the open head width, the opposed head width, and the handle width being positioned in relationship with said outer surface, said plate member forming a first aperture at said transverse edge, the open head being positioned at said first aperture with the gripping space being aligned with said first aperture, said first aperture and said gripping space being adapted to receive said grinding while during the grinding operation, wherein said fixture means includes clamping means for releasably holding the at least one wrench in relationship with said outer surface of said plate member and said gripping space in alignment with said first aperture, wherein said clamping means includes a clamping bar connected to said fixture means and positioned spaced from said outer surface of said plate member, said clamping bar being movable between clamping and unclamping positions, wherein in said clamping position said clamping bar is positioned at a first distance from said plate member so as to press the at least one wrench against said outer surface of said plate member so that the at least one wrench is immobile during the grinding operation, and wherein in said unclamping position said clamping bar is positioned at a second distance greater than said first distance from said plate member so that the at least one wrench is removable from or placeable between said clamping bar and said plate member, wherein said clamping means further includes clamp pressuring means mounted to said fixture means for maintaining said clamping bar at said clamping position, wherein said clamp pressuring means includes at least one piston rod having opposed ends, one end being located spaced from said outer surface of said plate member and connected to said clamping bar and the other end being spaced from said inner surface of said plate member, said at least one rod being adapted to slidably pass through said plate member; a bracing member connected to the other end of said rod and positioned between said inner surface of said plate member and said other end of said piston rod; and biasing means in operative association with said rod and extending between said bracing member and said plate member, said biasing means being movable between biased and unbiased modes, wherein in said unbiased mode said biasing means has biased said bracing member way from said inner surface of said plate member so as to move said clamping bar to said clamping position, and wherein in said biased mode said bracing member has been moved toward said inner surface of said plate member so as to force said at least one rod to move said clamping bar to said unclamping position and to force said biasing means to a biased mode between said bracing member and said plate member, wherein said fixture means further includes clamp unpressing means mounted to said fixture means, said clamp unpressing means being for moving said clamping bar from said first position to said second position, whereby the at least one wrench can be removed from between the plate member and the clamping bar after the grinding operation or placed between the plate member and the clamping bar before the grinding operation, wherein said clamp unpressing means includes a push bar connected to said other end of said piston rod and a source of pressure adapted to be placed in operative connection to said push bar and thus to said bracing member via said at least one piston rod wherein said clamping bar is moved from said clamping position to said unclamping position and said biasing means is moved from said unbiased mode to said biased mode when said source of pressure is activated, and further including a support plate extending transverse from said inner surface side of said plate member in a plane generally parallel with said transverse edge, and a support bar lateral to said plate member and transverse to said at least one piston rod, said support bar being connected to said support plate between said push bar and said bracing member, said at least one piston rod slidably extending through said support bar, said support bar being lateral to said plate member, said support plate having opposed edges extending transversely from said plate member, said key means being tapered walls extending inwardly form said opposed edges adapted to be received by said keyway means of said jig means.

2. The system according to claim 1, further including lateral holding means associated with said fixture means and with said jig means for preventing said fixture means from moving laterally relative to said jig means in one direction perpendicular to said axis during the grinding operation.

3. The system according to claim 1, further including wrench mounting means connected to said plate member at said front surface for supporting the at least one wrench during the mounting of the wrench when said clamping bar is in said second position.

4. The system according to claim 3, wherein the at least one wrench is supported by said wrench mounting means from the closed head end with the open head end extending downwardly toward said transverse edge.

5. The system according to claim 4, wherein said wrench mounting means includes a pair of spaced support pins extending generally perpendicularly from said outer surface of said plate member, the at least one wrench being adapted to be supported by said spaced support pins at the closed end.

6. The system according to claim 1, wherein said biasing means are biasing elements positioned around said at least one piston rod between said bracing member and said plate member.

7. The system according to claim 1, wherein said biasing elements are a plurality of helical washers.

8. The system according to claim 1, wherein said lifting means is a hydraulically operated table.

9. The system according to claim 1, wherein said clamping bar has an edge aligned along said transverse edge of said plate member, said clamping bar forming a second aperture along said edge aligned with said gripping space of the at least one wrench and with said second aperture.

10. The system according to claim 1, wherein said lateral holding means includes a clamping mechanism including a keeper portion, said clamping mechanism being mounted to said fixture means along said keyway means, said clamping mechanism being pivotable about a longitudinal axis between clampdown and release positions, wherein in said clampdown position said keeper portion clamps said key means of said fixture means and in said release position said keeper portion is spaced from said key means, said clamping mechanism including a fluid pressure system adapted to be connected to a source of hydraulic pressure.

11. The system according to claim 1, further including a mounting support and keeper means connected to said mounting support for holding said fixture means immobile during movement of said clamping bar from said first to said second position and during mounting and demounting of the wrench to and from said fixture means when said clamping bar is maintained in said second position, said support bar having opposed end portions, said keeper means including a side bar mounted adjacent to one of said end portions, a fluid pressure device mounted to said mounting support adjacent to the other of said end portions, and a source of fluid pressure connected to said fluid pressure device, said support bar having a fluid chamber at the other of said end portions of said support bar with an aperture adapted to receive fluid pressure from said fluid pressure device which when activated causes said fluid pressure device to exert pressure against said other of said end portions so as to press said one of said end portions against said side bar with sufficient force to immobilize said fixture.

12. The system according to claim 11, further including another support bar connected to said support plate and positioned adjacent to said inner surface of said plate member, said keeper means further including another fluid pressure device connected to said source of fluid pressure, said another support bar also being adapted to be pressed against said side bar by said another fluid pressure device, said at least one piston rod slidably extending through said another support bar.

13. The system according to claim 11, further including alignment means for positioning said gripping space of the at least one wrench with said wheel center plane, said alignment means including an elongated key mounted to said mounting support and extending from a position spaced from said plate member to a position under said plate member and perpendicular to said plate member, said first aperture of said plate member and said gripping space being adapted to be positioned over said elongated key during mounting of said at least one wrench to said fixture means.

14. The system according to claim 1, wherein said at least one wrench is a plurality of wrenches.

15. The system according to claim 1, wherein said at least one piston rod is a pair of spaced piston rods.

16. A method for sizing and finishing the opposed interior side walls and an interior bottom wall extending between the interior side walls at an open head at one end of a straight handle of an unfinished wrench, the interior side walls and the interior bottom wall defining a gripping space between said fixed jaws which define an opening to said space, comprising the following steps:

(a) placing a fixture upon a mounting support;
(b) securing said fixture to said mounting support;
(c) preparing said fixture for receipt of at least one open-ended wrench;
(d) placing the at least one open-ended wrench onto said fixture;
(e) securing said at least one wrench to said fixture;
(f) unsecuring said fixture from said mounting support;
(g) removing said fixture from said mounting support;
(h) placing and securing said fixture with said at least one wrench onto a jig secured to a vertically movable table, said jig being positioned under a creep feed grinding machine, the opening of the open end of the at least one wrench being aligned under the creep feed grinding wheel, the axis of the wheel being aligned with a midplane extending between the jaws of the open head and with the center plane of the wheel being aligned with a vertical center plane extending between the open jaws;
(i) activating the creep feed grinding machine;
(j) activating said table so that said table raises said jig and said fixture upwardly until the gripping space of the at least one wrench so that the interior side and bottom surfaces of the open jaws are sized and finished in one pass of said grinding wheel;
(k) lowering said table;
(l) removing said fixture from said jig;
(m) placing said fixture with the sized and finished at least one wrench upon said mounting support as in step (a);
(n) securing said fixture to said support plate as in step (b);
(o) preparing said fixture for removal of the sized and finished wrench in the manner of step (c); and
(p) removing the sized and finished at least one wrench from said fixture.

17. The method described in claim 16, wherein said at least one wrench is a plurality of wrenches.

18. The method described in claim 16, wherein step (a) of claim 16 includes said fixture having a plate member and said mounting support having an elongated key, said plate member having a front surface and a reverse rear surface and a transverse edge having an aperture, said plate member being placed upon said mounting support with said first aperture being fitted over said key, said plate member being generally perpendicular to said mounting support and to said key.

19. The method described in claim 18, wherein step (c) of claim 16 includes pressuring a clamping bar that extends across said front surface of said plate member so as to move said clamping bar from a first position at a first distance from said front surface to a second distance from said plate member greater than said first distance, the clamping bar being held in said first position by biasing means, said biasing means being in an unbiased mode when said clamping bar is in said first position and in a biased mode when said clamping bar is in said second position.

20. The method described in claim 19, wherein step (d) includes placing the at least one open-ended wrench between said clamping bar and said outer surface of said plate member.

21. The method described in claim 20, wherein step (d) further includes the following steps:

(1) hanging the opposed head of the at least one wrench, which is at the end of the handle opposite the open head, from support means on the outer surface of the plate member for holding the at least one wrench at the opposed head; and (2) placing the gripping space of the open head of the at least one wrench into alignment with said key.

22. The method described in claim 21, wherein step (e) of claim 16 includes releasing the pressure on said clamping bar so that said clamping bar is forced back to said first position by said biasing means so that said clamping bar pressures the at least one wrench against said outer surface of said plate member thus gripping the at least one wrench to said fixture with said gripping space being in alignment with said first aperture of said plate member.

23. The method described in claim 22, further including the following step between steps (g) and (h) in claim 16: inverting said fixture so that said transverse edge of said plate member and said opening of said open head of the at least one wrench are oriented upwardly.

24. The method described in claim 23, further including the following step between steps (l) and (m) in claim 16: inverting said fixture so that said transverse edge of said plate member and said opening of said open head of the sized and finished at least one wrench are oriented downwardly.

25. The method described in claim 19, wherein said biasing means is associated with at least one piston rod and with a bracing member attached to said piston rod at a position spaced from said rear surface, said piston rod being attached to said clamping bar and passing through said plate member, said biasing means being positioned between said plate member and said bracing member in association with said piston rod, the pressure described in step (c) of claim 16 being exerted against said bracing member.

26. A system for sizing and finishing the opposed interior side walls and an interior bottom wall extending between the interior side walls at an open head at one end of a straight handle of an unfinished open-ended wrench, the interior side walls and the interior bottom wall defining a gripping space between fixed jaws which define an opening to said space, comprising, in combination, a creep feed grinding machine including a creep feed grinding wheel rotatable about an axis and having a wheel center plane perpendicular to said axis, fixture means for gripping at least one wrench, the gripping space having a jaws center plane spaced between the jaws and a jaws midplane extending across said jaws perpendicular to said jaws center plane, jig means for maintaining said fixture means in a position whereon the jaws of the at least one wrench are positioned directly under said grinding wheel with said jaws center plane aligned with said wheel center plane and said jaws midplane aligned with said wheel axis, lifting means for maintaining said jig means under said wheel and for raising said jig means with said fixture means upwardly to said grinding wheel as said grinding wheel sizes and finishes the interior side and bottom surfaces of the jaws of the at least one wrench in a single pass of said wheel, said least one wrench having an opposed head at the other end of the handle opposite to the one head, the handle having a handle length, width, and thickness, the opposed head having a head with greater than the handle width, and the open head having an open head width, and wherein said fixture means includes a plate member having reverse inner and outer surface and a transverse edge, the open head width, the opposed head width, and the handle width being positioned in relationship with said outer surface, said plate member forming a first aperture at said transverse edge, the open head being positioned at said first aperture with the gripping spaced being aligned with said first aperture, said first aperture and said gripping space being adapted to receive said grinding wheel during the grinding operation, said fixture means further including clamping means for releasably holding the at least one wrench in relationship with said outer surface of said plate member and said gripping space in alignment with said first aperture, transverse holding means associated with said fixture mans and said jig means for removably mounting said fixture means to said jig means and preventing said fixture means from moving transversely relative to said jig means in directions parallel to said axis during the grinding operation, said transverse holding means including said fixture means having key means and said jig means having keyway means, said key means being removably mountable to said keyway means, said clamping means including a clamping bar connected to said fixture means and positioned spaced from said outer surface of said plate member, said clamping bar being movable between clamping and unclamping positions, wherein in said clamping position said clamping bar is positioned at a first distance from said plate member so as to press the at least one wrench against said outer surface of said plate member so that the at least one wrench is immobile during the grinding operation and wherein in said unclamping position said clamping bar is positioned at a second distance greater than said first distance from said plate member so that at least one wrench is removable from or placeable between said clamping bar and said plate member, said clamping means further including clamp pressuring means mounted to said fixture means for maintaining said clamping bar at said clamping position.

said clamp pressuring means including at least one piston rod having opposed ends, one end being located spaced from said outer surface of said plate member and connected to said clamping bar and the other end being spaced from said inner surface of said plate member, said at least one rod being adapted to slidably pass through said plate member; a bracing member connected to the other end of said rod and positioned between said inner surface of said plate member and said other end of said piston rod; and biasing means in operative association with said rod and extending between said bracing member and said plate member, said biasing means being movable between biased and unbiased modes, wherein in said unbiased mode said biasing means has biased said bracing member away from said inner surface of said plate member so as to move said clamping bar to said clamping position, and wherein in said biased mode said bracing member has been move toward said inner surface of said plate member so as to force said at least one rod to move said clamping bar to said unclamping position and to force said biasing means to a biased mode between said bracing member and said plate member, said fixture means further including clamp unpressing means mounted to said fixture means, said clamp unpressing means being for moving said clamping bar from said first position to said second position, whereby the at least one wrench can be removed from between the plate member and the clamping bar after the grinding operation or placed between the plate member and the clamping bar before the grinding operation, said clamp unpressurizing means including a push bar connected to said other end of said piston rod and a source of pressure adapted to be paced in operative connection to said push bar and thus to said bracing member via said at least one piston rod wherein said clamping bar is moved from said clamping position to said unclamping position and said biasing means is moved form said unbiased mode to said biased mode when said source of pressure is activated, and a support plate extending transversely from said inner surface side of said plate member in a plane generally parallel with said transverse edge, and a support bar lateral to said plate member and transverse to said at least one piston rod, said support bar being connected to said support plate between said push bar and said bracing member, said at least one piston rod slidably extending through said support bar, said support bar being lateral to said plate member, said support plate having opposed edge extending transversely from said plate member, said key means being tapered walls extending inwardly from said opposed edge adapted to be received by said keyway means of said jig means.

27. The system according to claim 26, wherein said key means and said keyway means are also for preventing said fixture from moving vertically relative to said jig means during the grinding operation.

28. A system for sizing and finishing the opposed interior side walls and an interior bottom wall extending between the interior side walls at an open head at one end of a straight handle of an unfinished open-ended wrench, the interior side wall and the interior bottom wall defining a gripping space between fixed jaws which define an opening to said space, comprising, in combination, a creep feed grinding machine including a creep feed grinding wheel rotatable about an axis and having a wheel center plane perpendicular to said axis, fixture means for gripping at least one wrench, the gripping space having a jaws center plane spaced between the jaws and a jaws midplane extending across said jaws perpendicular to said jaws center plane, jig means for maintaining said fixture means in a position wherein the jaws of the at least one wrench are positioned directly under said grinding wheel with said jaws center plane aligned with said wheel center plane and said jaws midplane aligned with said wheel axis, lifting means for maintaining said jig means under said wheel and for raising said jig means with said fixture means upwardly to said grinding wheel as said grinding wheel sizes and finishes the interior side and bottom surfaces of the jaws of the at least one wrench in a single pass of said wheel, said least one wrench having an opposed head at the other end of the handle opposite to the one head, the handle having a handle of length, width, and thickness, the opposed head having a head width greater than the handle width, and the open head having an open head width, and said fixture means including a plate member having reverse inner and outer surfaces and a transverse edge, the open head width, the opposed head width, and the handle width being positioned in relationship with said outer surface, said plate member forming a first aperture at said transverse edge, the open head being positioned at said first aperture with the gripping space being aligned with said first aperture, said first aperture and said gripping space being adapted to receive said grinding wheel during the grinding operation, said fixture means further including clamping means for releasably holding the at least one wrench in relationship with said outer surface of said plate member and said gripping space in alignment with said first aperture, said clamping means being movable between clamping and unclamping positions, wherein in said clamping position said clamping means is positioned at a first distance from said plate member so as to press the at least one wrench against said outer surface of said plate member so that the at least one wrench is immobile during the grinding operation, and wherein in said unclamping position said clamping means is positioned at a second distance greater than said first distance from said plate member so that that the at least one wrench is removable from or placeable between said clamping means and said plate member, transverse holding means associated with said fixture means and said jig means for removably mounting said fixture means to said jig means and preventing said fixture means from moving transversely relative to said jig means in directions parallel to said axis during the grinding operation, said transverse holding means including said fixture means having key means and said jig means having keyway means, said key means being removably mountable to said keyway means, a support plate extending transversely from said inner surface side of said plate member in a plane generally parallel with said transverse edge, a support bar lateral to said plate member and connected thereto, said support bar being connected to said support plate and said support plate having opposed edges extending transversely from said plate member, said key means being tapered wall extending inwardly from said opposed edges adapted to be received by said keyway means of said jig means, and clamp unpressuring means mounted to said fixture means, said clamp unpressuring means being for moving said clamping means from said first position to said second position, whereby the at least one wrench can be removed from between the plate member and the clamping means after the grinding operation or placed between the plate member and the clamping bar before the grinding operation.

29. The system according to claim 28, wherein said clamping means includes a clamping bar connected to said fixture means and positioned spaced from said outer surface of said plate member, said clamping bar being movable between clamping and unclamping positions, wherein in said clamping position said clamping bar is positioned at a first distance from said plate member so as to press the at least one wrench against said outer surface of said plate member so that the at least one wrench is immobile during the grinding operation, and wherein in said unclamping position said clamping bar is positioned at a second distance greater than said first distance from said plate member so that the at least one wrench is removable from or placeable between said clamping bar and said plate member.

30. The system according to claim 29, wherein said clamping means further includes clamp pressuring means mounted to said fixture means for maintaining said clamping bar at said clamping position.

31. The system according to claim 30, wherein said clamp pressuring means includes at least one piston rod having opposed ends, one end being located spaced from said outer surface of said plate member and connected to said clamping bar and the other end being spaced from said inner surface of said plate member, said at least one rod being adapted to slidably pass through said plate member; a bracing member connected to the other end of said rod and positioned between said inner surface of said plate member and said other end of said piston rod; and biasing means in operative association with said rod and extending between said bracing member and said plate member, said biasing means being movable between biased and unbiased modes, wherein in said unbiased mode said biasing means has biased said bracing member away from said inner surface of said plate member so as to move said clamping bar to said clamping position, and wherein in said biased mode said bracing member has been moved toward said inner surface of said plate member so as to force said at least one rod to move said clamping bar to said unclamping position and to force said biasing means to a biased mode between said bracing member and said plate member.

32. The system according to claim 31, wherein said clamp unpressuring means includes a push bar connected to said other end of said piston rod and a source of pressure adapted to be placed in operative connection to said push bar and thus to said bracing member via said at least one piston rod wherein said clamp bar is moved from said clamping position to said unclamping position and said biasing means is moved from said unbiased mode to said biased mode when said source of pressure is activated, and said support bar being connected to said support plate between said push bar and said bracing member, said at least one piston rod slidably extnding through said support bar.

33. The system according to claim 28, wherein said key means and said keyway means prevent said fixture from moving vertically relative to said jig means during the grinding operation.

* * * * *